United States Patent [19]

Fujita

[11] Patent Number: 4,606,745

[45] Date of Patent: Aug. 19, 1986

[54] CONDENSER-EVAPORATOR FOR LARGE AIR SEPARATION PLANT

[75] Inventor: Ikuo Fujita, Yokohama, Japan

[73] Assignee: Nippon Sanso Kabushiki Kaisha, Tokyo, Japan

[21] Appl. No.: 738,589

[22] Filed: May 28, 1985

[30] Foreign Application Priority Data

May 30, 1984 [JP] Japan ..... 59-110127

[51] Int. Cl.[4] ..... F25J 3/04

[52] U.S. Cl. ..... 62/42; 165/145; 165/166; 122/32; 202/153

[58] Field of Search ..... 62/42, 29, 516, 519; 165/110, 111, 143, 145, 166; 122/32; 202/153, 155, 156

[56] References Cited

U.S. PATENT DOCUMENTS 3,256,704 6/1966 Becker ..... 62/42

3,289,757 12/1966 Rutledge ..... 165/166

FOREIGN PATENT DOCUMENTS 56-130201 10/1981 Japan ..... 62/42

*Primary Examiner*—S. Leon Bashore

*Assistant Examiner*—Andrew J. Anderson

*Attorney, Agent, or Firm*—Darby & Darby

[57] ABSTRACT

A condenser-evaporator for use in a large air separation plant in which the condenser-evaporator is provided between an upper column and a lower column, the condenser-evaporator condensing nitrogen gas, ascending from the lower column through first conduit, by heat exchange with liquid oxygen flowing down from an upper column through second conduit. The condenser-evaporator includes a plurality of condenser blocks wherein the oxygen chambers of each condenser block are divided in a vertically multistage manner by partition members and wherein the nitrogen chambers of each condenser block form common passages through all the stages.

11 Claims, 8 Drawing Figures

CONDENSER-EVAPORATOR FOR LARGE AIR SEPARATION PLANT

This invention relates to an improvement in a condenser-evaporater (hereinafter referred to as condenser) provided between upper and lower columns of a double column rectifier for a large air separation plant.

In a double column rectifier for a large air separation plant having a oxygen gas recovery rate of not less than 10,000 $m^3/h$, a condenser of large dimensions is necessarily employed. In conventional condensers, a plurality of condenser blocks are arranged parallel in them, so that the diameter of the condenser is greatly increased. Therefore, the condenser, upper column and lower column are built separately and then assembled together. However, the construction of the rectifier in this manner increases the number of manufacturing steps and also the number of assembling steps since the assembling steps necessitate a great number of conduits. In the case where a prefabricated rectifier is transported to a building site, a number of frames are needed for preventing the parts of the assembled rectifier from being vibrated, and hence it is very difficult to carry such a product. Thus, it is almost impossible to ship this prefabricated product of the cold box.

Under such circumstances, there has been proposed a condenser in which condenser blocks are vertically arranged in multistages, and in which the diameter of the condenser is set to be substantially equal to the upper and lower columns. With such a construction, the condenser is made integrally with the upper and lower columns and thereby the above-mentioned drawbacks are overcome.

The reasons why in this condenser the condenser blocks must be arranged vertically in multistage manner reside in that the difference between the temperatures of nitrogen and oxygen is an important factor for determining a required heat transfer surface area of the heat exchanger. More specifically, if a condenser block is made vertically long, the saturation temperature of liquid oxygen increases due to the head pressure thereof, and hence the difference between the temperature of the oxygen chamber and that of the nitrogen chamber decreases, with the result that the heat transfer surface area of the condenser must be increased. Consequently, an uneconomical condenser with a relatively low heat exchange effectiveness is obtained. An air separation plant is designed so that the condenser usually has a temperature difference of 2° to 3° C. and hence in order to improve the condenser in heat exchange capacity per heat transfer surface area it is advantageous to set the height of the condenser blocks as small as possible and to thereby minimize the head pressure of liquid oxygen.

To meet this requirement there has been proposed a condenser of a double column rectifier in which the upper and lower columns and condenser are integrally formed and in which condenser blocks are vertically arranged in multistages and in which condenser blocks in each stage are isolated to be separately immersed in liquid oxygen. However, when condenser blocks are constructed in many stages, a large number of small blocks are necessary. This increases the manufacturing cost of the condenser and makes piping rather complicated since conduits for introducing nitrogen gas from the lower column and for introducing liquid nitrogen to the lower column are needed for each condenser blocks.

SUMMARY OF THE INVENTION

Accordingly, it is an object of the present invention to provide a condenser for a large air separation plant, which is less complicated in piping for carrying nitrogen between condenser blocks and the lower column and for carrying liquid oxygen.

It is another object of the present invention to provide a condenser for a large air separation plant which is more efficient than prior art arrangements.

With these and other objects in view, the present invention provides a condenser for use in a large air separation plant in which the condenser is provided between an upper column and a lower column, the condenser condensing nitrogen gas, ascending from the lower column through first conduit, by heat exchange with liquid oxygen flowing down from a upper column through second conduit. The condenser includes: (a) a plurality of vertical condenser blocks each having upper and lower ends and lateral edges and including first corrugated fins for forming nitrogen passages as nitrogen chambers, second corrugated fins for forming oxygen passages as oxygen chambers, the first fins and the second fins being each alternatively laminated through a separating plate to vertically form the nitrogen passages each opening at the upper and the lower ends of the condenser block and to form the oxygen passages each opening at the lateral edges of the condenser block, the oxygen chambers of each block being divided into vertically disposed multistage groups; (b) a first header provided to the upper end of each condenser block, the first header being connected through the first conduit for introducing nitrogen gas from the lower column into the nitrogen chambers of the condenser blocks; (c) a second header provided to the lower end of each condenser block, (d) a third conduit, connected to each second header, for extracting nitrogen condensed in the nitrogen chambers of the condenser blocks; (e) a mechanism for forming vertically disposed multistage compartments, which enclose each stage of the condenser blocks, including a lowermost stage compartment, the compartments forming mechanism including a head portion of the lower column for forming the lowermost compartment; (f) overflowing mechanism, provided to each compartment disposed above the lowermost compartment, for overflowing liquid oxygen supplied from the upper column substantially at a level to immerse each group of the oxygen chambers in the liquid oxygen; (g) a fourth conduit communicated to the overflowing mechanism, for introducing the liquid oxygen overflowing from one compartment into another lower compartment disposed just below the one compartment; and (h) oxygen ascending conduit, communicated to each compartment, for ascending and introducing into the upper column oxygen gas produced in each compartment by heat exchange with nitrogen gas.

In the condenser according to the present invention, oxygen chambers of each condenser block are divided in a vertically multistage manner by partition members and hence the condenser may be built integrally with the upper and lower columns. In the present invention the nitrogen chambers in each condenser block form common passages for the whole stages and thus nitrogen gas from the lower column is merely supplied to the head portions of the condenser blocks. This structure reduces the number of conduits between the lower column and the condenser blocks, so that the construction of the condenser is simplified. This facilitates building of the condenser.

DETAILED DESCRIPTION OF THE PREFERRED EMBODIMENTS

Figure 1:
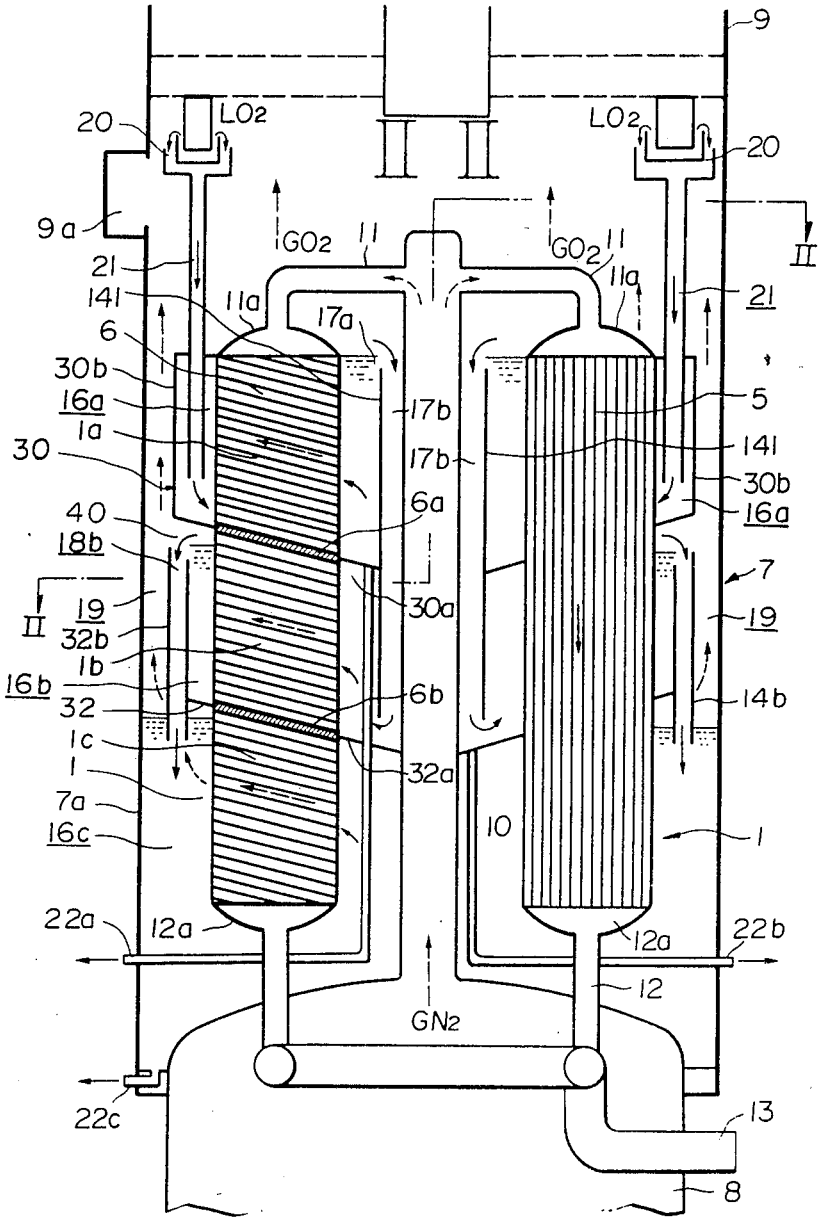
FIG. 1 is a diagrammatical vertical section of the condenser according to the present invention.

One embodiment of the present invention will be described with reference to FIGS. 1-3. In FIG. 3, a condenser block 1 is formed in laminated multilayers by alternately laminating corrugated fins 2 and perforated, corrugated fins 3 via separator plates 4. The corrugated fins 2 are set up so as to form vertical passages and on the other hand the perforated, corrugated fins 3 are set up so as to form passages which are somewhat inclined with respect to a horizontal plane. The vertical passages serves as nitrogen chambers 5 in which a nitrogen gas from a lower column 8 is liquefied as it flows down, and the inclined passages of the perforated fins 3 as oxygen chambers 6 in which a liquid oxygen from an upper column 9 is gasified as it flows there. Each nitrogen chamber 5 has opposite openings at upper and lower ends of the condenser block 1 and each oxygen chamber 6 has opposite openings at opposite lateral ends. The opposite lateral ends of each fin 2 are closed with bars 2*a* and upper and lower ends of each fin 3 are closed with bars 2*b*. Each laminated layer of the oxygen chambers 6 are formed by three corrugated, perforated fins 3 vertically arranged through partition bars 6*a* and 6*b*. As clearly shown in FIG. 3, the two partition bars 6*a* and 6*b* divide the oxygen chambers 6 of each laminated layer into three stages or parts having substantially an equal height. The corrugated fins 3 are disposed with a little inclination with respect to a horizontal plane for the purpose of facilitating upward flow of oxygen gasified in the oxygen chambers 6. The perforated fins 3 may be disposed horizontally although the larger the inclination angle of the fins 3 the larger the upward flow rate of the oxygen gas. However, this increase in inclination angle of the flow passages of oxygen chamber 6 elevates the level of liquid oxygen in compartments which will be described later, resulting in an increase in head pressure of the liquid oxygen. This is disadvantageous in heat exchange as described above. The inclination angle of the oxygen chamber 6 may be set to any angle provided that oxygen gas evaporated in the oxygen chamber 6 smoothly ascends. In most cases, the inclination angle is more than about 5 degrees with respect to horizontal plane. The upper limit of the inclination angle is set according to design conditions in view of a rise in head pressure of liquid oxygen.

The use of the perforated fins 3 enhances gas-liquid separation effect since oxygen gas which is evaporated as it passes one oxygen chamber 6 is introduced through the perforations of the fin 3 into the adjacent upper oxygen chamber 6 at once.

If the perforations of the perforated fin 3 have a size that will permit liquid oxygen to freely pass them, they produce an effect of preventing impurities condensation. The corrugated, perforated fins 3 generally generate turbulence in fluid flow and thereby enhance efficiency of heat exchange. Thus, perforated fins 3 may be used for forming the nitrogen chambers 5. Instead of three perforated fins 3 a single perforated fin may be used for forming each laminated layer of oxygen chambers 6, in which case two partition rods having a complementary shape of the oxygen chambers 6 are fitted into two oxygen chambers 6 to form three stages of oxygen chambers 6 as the partition rods 6*a* and 6*b*. Other kinds of fins having opening portions, such as multi-entry fin, produce the same advantageous effects as the perforated fins 3. Instead of the perforated fins, nonperforated straight fins may be used.

Figure 2:
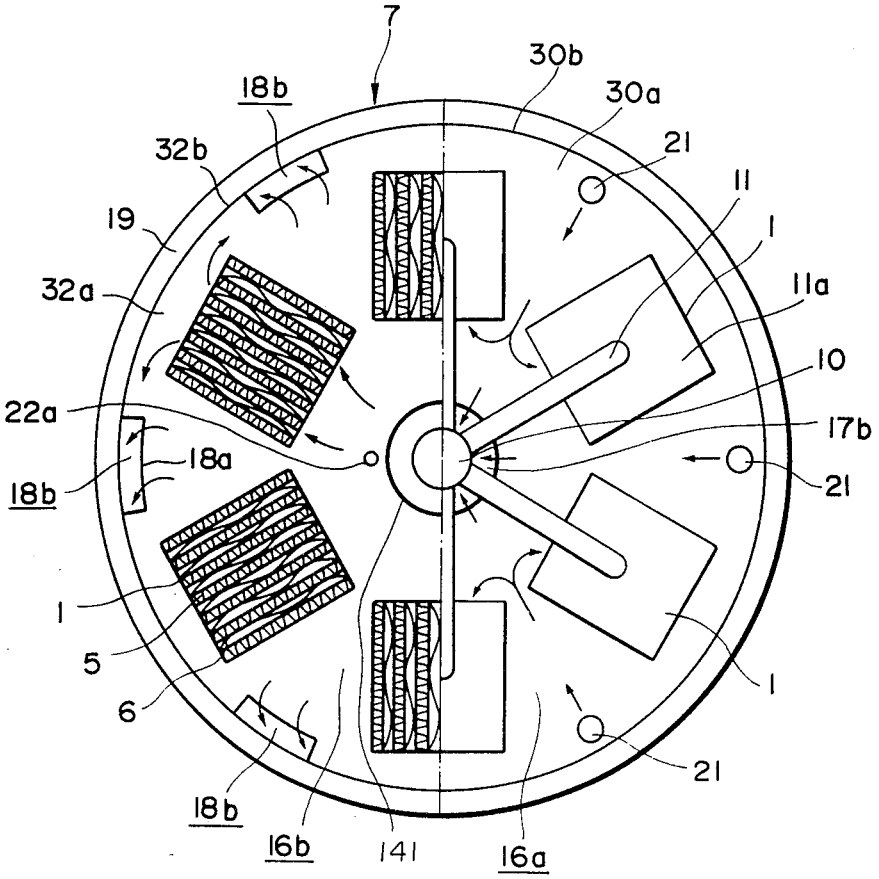
FIG. 2 is a cross-section taken along the line II—II in FIG. 1.
Figure 3:
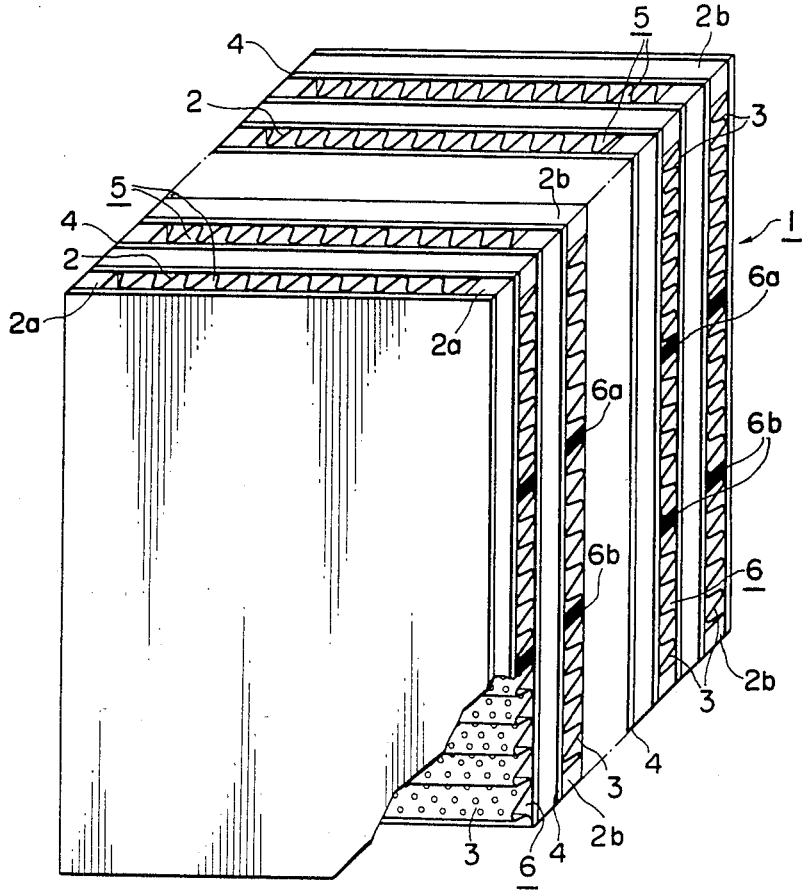
FIG. 3 is an enlarged perspective view of an essential part, partly broken away, of the condenser block in FIG. 2 with vertically modified scale.

Referring now to FIGS. 1 and 2, a condenser 7 is provided between lower and upper columns 8 and 9 and six condenser blocks 1 are arranged annularly therein. A main nitrogen gas conduit 10, connected to a head of the lower column 8 and extending upward, is connected at its upper end portion to headers 11*a*, which are provided at the upper ends of the condenser blocks 1, via nitrogen gas branch conduits 11. Liquid nitrogen branch conduits 12, which are connected to headers 12*a* provided to lower ends of the condenser blocks 1, pass through a head of the lower column 8 and are collectively connected to a main liquid nitrogen conduit 13. Liquid nitrogen branch conduits 12 and main liquid nitrogen conduit 13 may be provided above the head of lower column 8 without passing through it.

Each condenser block 1 is divided into three vertically disposed parts by two funnel-shaped partitions 30 and 32, the bottom 30*a*, 32*a* of which are parallel with the partition bars 6*a* and 6*b* and hence somewhat inclined with respect to a horizontal plane. The three parts form an upper condenser block 1*a*, middle condenser block 1*b* and lower condenser block 1*c*. The main nitrogen gas conduit 10 concentrically passes through the funnel-shaped partition 30 and 32 and further a conduit 141 concentrically passes through the bottom 30*a* of the upper partition 30 to be placed around the main conduit 10 to form an annular overflow passage 17*b* between the conduit 141 and the main conduit 10. Thus, an upper annular compartment 16*a* is defined by the upper partition 30 and the conduit 141, an annular compartment 16*b* by the lower partition 32 and the conduit 141 and a lower compartment 16*c* by the casing 7*a*, the main conduit 10 and the head of the lower column 8. Although by the division with the partition rods 6*a* and 6*b*, the oxygen chambers 6 are separated into upper, middle and lower stages of oxygen chamber, nitrogen chambers 5 continuously pass through each condenser block 1. In this embodiment, opposite ends of the partition rods 6*a* and 6*b* are welded to the bottoms 30*a* of the partition 30 and the bottom 32*a* of the partition 32 respectively. However, when the thickness of the bottoms 30*a* and 32*a* is larger than the pitch of the corrugation of the fins 3, the partition rods 6*a* and 6*b* may be replaced by the bottom 30*a* and 32*a*.

Further, in this embodiment, nitrogen gas is fed through the main conduit 10 and branch conduits 11 to each condenser block 1, but an individual conduit may be provided for connecting the head of the lower column to each condenser block 1.

The upper stage compartment 16*a* is provided at its inner wall, i.e., conduit 141 with an annular upper flow opening 17*a*, connected to the conduit 141 so that liquid oxygen in the upper stage compartment 16*a* overflows at a level above or substantially equal to the top of the upperstage condenser block 1*a* and flows down through the upperstage overflow passage 17*b* into the middle stage compartment 16*b*. The middle stage compartment 16*b* is provided at the outer peripheral portion thereof with a middle stage overflow passage 18*b* having inlet 18*a* so that liquid oxygen in the compartment 16*b* overflows at a level substantially equal to or above the top of the middle stage condenser block 1*b* and flows down through the overflow passages 18*b* into the lower stage compartment 16*c*. Each overflow passage 18*b* is defined by the inner wall of the flange 32*b* of the lower partition 32 and a channel member 18*a* welded at free ends of both flanges thereof to the flange 32*b* and vertically passing through the bottom 32*a* of the partition 32. The cross-section of the overflow passage 18*b* is not restricted to a rectangular shape as shown but may be other shape such a circle, and the overflow passage may be formed away from the flange 32*b* of the partition 32. Further, between the outer wall 7*a* of the condenser 7 and the flanges 30*b*, 32*b* of the partitions 30, 32, there is provided an annular passage 19 for ascending evaporated oxygen gas. Reference numeral 20 denotes a liquid oxygen receiver provided below the lowermost fractionating plate of the upper column 9 and the receiver 20 is adapted to collect liquid oxygen flowing down from the upper column 9. 21 designates a liquid oxygen guide passage connected to the liquid oxygen receiver 20 and adapted to drop the liquid oxygen into the upper compartment 16*a*. The liquid oxygen guide passage 21 may also be formed in a suitable shape as the overflow passage 18*b*. In this embodiment, the liquid oxygen guide passage 21 is a straight pipe and extends to a position near the outer wall 30*b* of the upper compartment 16*a*. This passage 21 may be bent inward at an intermediate portion so as to extend to a position near the inner circumferential wall of the upper compartment 16*a*. Reference numerals 22*a*, 22*b* and 22*c* denote liquid oxygen blow conduits connected to the bottoms of the compartments 16*a*, 16*b*, 16*c*, respectively. Part of liquid oxygen is blown from these blow conduits to the outside at predetermined time to prevent hydrocarbons, such as acetylene, from being concentrated and to thereby enhance the safety of the condenser.

In the above-described construction, the liquid flows are indicated by solid arrows, and the gas flows by broken arrows. The nitrogen from the lower column 8 is introduced into the headers 11*a* at the upper end portions of the condenser blocks via the main nitrogen gas conduit 10 and branch nitrogen-gas conduits 11 as shown by arrows in FIG. 1. While the nitrogen flows down through the nitrogen chambers 5, it is subjected to heat exchange with liquid oxygen to be liquefied, and the resultant nitrogen flows down into the headers 12*a* at the lower ends of the nitrogen chambers 5. The liquid nitrogen is then collected via the branch liquid-nitrogen conduits 12 to the main liquid nitrogen conduit 13 through which it is discharged to the outside of the column. The liquid oxygen flowing down from the upper column 9 enters the upper compartment 16*a* via the liquid oxygen receivers 20 and the liquid oxygen guide passages 21 as shown by arrows in FIG. 1. The liquid oxygen then enters the oxygen chambers 6 in the upper stage condenser blocks 1*a* as it immerses the blocks 1*a* in it so that it is subjected to heat exchange with the nitrogen gas in the nitrogen chambers 5. The oxygen which has been gasified by this heat exchange moves up within the oxygen chambers 6 which have slightly inclined passages and finally return to the upper column 9 from open upper end of the upper compartment 16*a*. During this time, part of the liquid oxygen which has not been gasified overflows from the upper overflow port 17*a* downwards and flows into the intermediate compartment 16*b* via the upper overflow passage 17*b*. The liquid oxygen in the intermediate compartment 16*b* is subjected to heat exchange with nitrogen gas in the same manner as previously mentioned to thereby produce gasified oxygen, which flows into the oxygen gas passage 19 through an annular gap 40 defined between the bottom 30*a* of the upper stage partition 30 and the upper edge of the flange 32*b* of the middle stage partition 32. Then, the gasified oxygen flows upwards through the oxygen gas passage 19 into the upper column 9. On the other hand, oxygen still in liquid state flows into the lower compartment 16*c* via the intermediate overflow port 18*a* and the intermediate overflow passage 18*b*. The liquid oxygen, thus introduced into the lower compartment 16*c*, is subjected to heat exchange with nitrogen gas in the same manner as previously mentioned, and only oxygen thus gasified returns to the upper column 9 via the oxygen gas passage 19. Part of the gasified oxygen is extracted as an oxygen gas product to the outside from an oxygen gas issuing port 9*a*.

In the embodiment above described six condenser blocks are provided but the number thereof may be determined according to need. The condenser blocks 1 may be divided into more or less than three parts or stages. The oxygen chamber shown in FIG. 1 are inclined upward from the center of the condenser 7 toward the outside, but they may be inclined in the other way, in which case the same operations may be made by appropriately modifying the design of associated portions.

Figure 4:
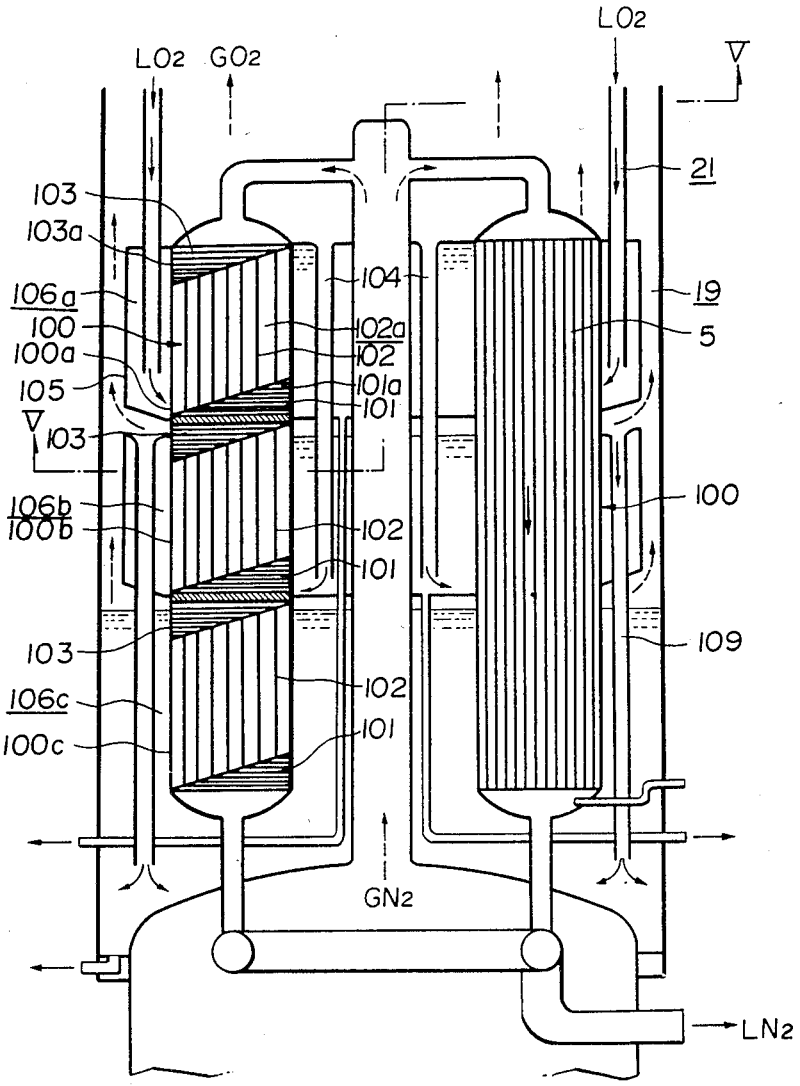
FIG. 4 is a diagrammatical vertical section of another embodiment of the present invention.
Figure 5:
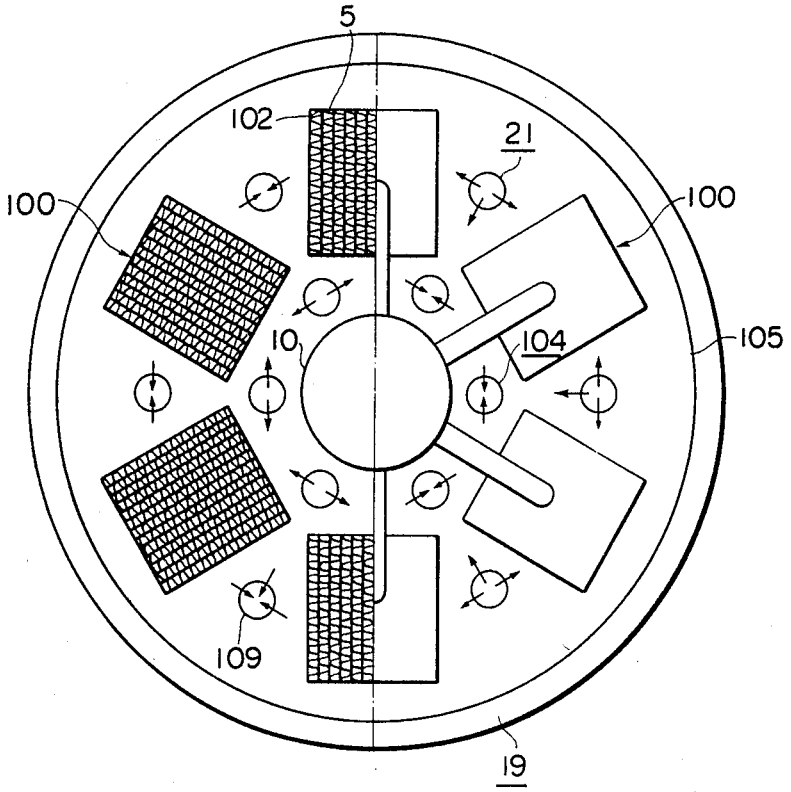
FIG. 5 is a cross-section taken along the line V—V in FIG. 4.

FIGS. 4 and 5 illustrate another embodiment of the present invention. Similar parts are hereinafter indicated by like reference numbers and explanation thereof is omitted. In this embodiment, in each stage 100*a*, 100*b*, 100*c* of the condenser blocks 100, oxygen passages of every laminated layer are continuously defined by three corrugated fins connected to each other. More specifically, each oxygen passage consists of lower horizontal passage 101*a* defined by a lower fin 101, vertical passage 102*a* defined by a vertical fin 102 and connected at its lower end to an outlet of the lower horizontal passage 101*a*, and upper horizontal passage 103*a* defined by an upper horizontal fin 103 and connected at its inlet to the upper end of the vertical passage 102*a*.

In each of the condenser blocks 100 having such oxygen passages, liquid oxygen enters from the inlet, opening to corresponding compartment, of each lower horizontal passage 101*a* and flows through the lower horizontal passage to be introduced into the vertical passage 102*a*, where it is partly evaporated as it ascends. Then, the liquid oxygen again horizontally flows through the upper horizontal passage 103*a*, thus issuing from the outlet thereof. With such a construction, evaporated oxygen gas is smoothly discharged outside the condenser block 100 and hence heat exchange is efficiently carried out. The nitrogen passages have the same structure as in the first embodiment and vertically and continuously pass through each condenser block 100.

In this second embodiment, in place of the annular overflow passage 17*b* in the first embodiment, six upper stage overflow conduits 104 are provided to pass through the bottom of the upper partition 105 for guiding overflow of liquid oxygen in the upper compartment 106*a* into the middle compartment 106*b*. Conduits 109 accomplish the same role as the passage 18*b* of the first embodiment.

Figure 6:
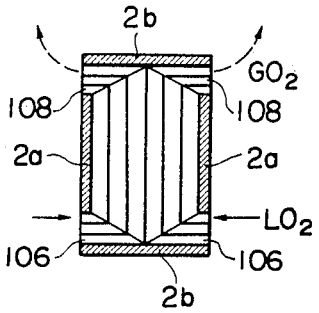
FIG. 6 is a vertical section of a modified condenser block part of the condenser in FIG. 4.

FIG. 6 shows a modified form of the fins 101, 102, 103 for liquid oxygen in which two inlets 106 and two outlets 108 are provided for liquid oxygen.

Figure 7:
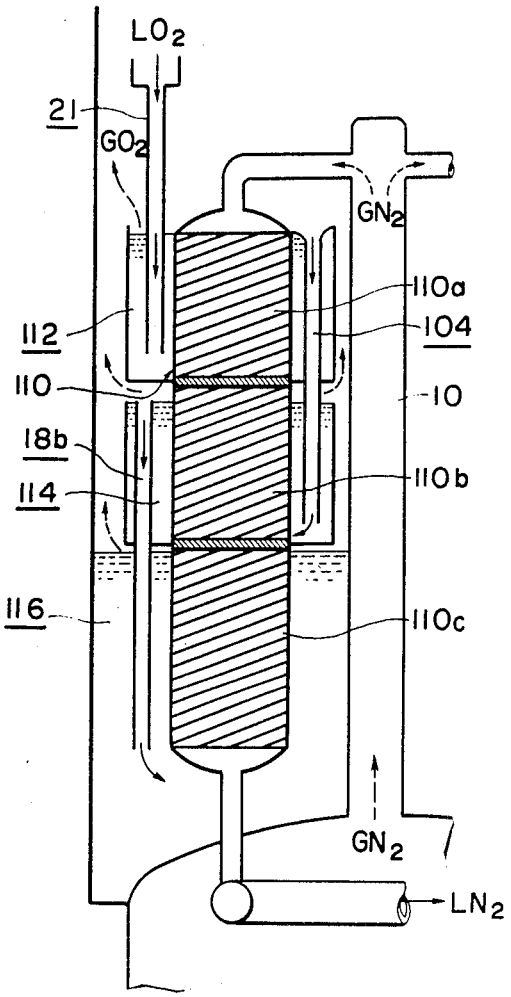
FIG. 7 is a diagrammatical, vertical section of a condenser block of still another embodiment of the present invention.
Figure 8:
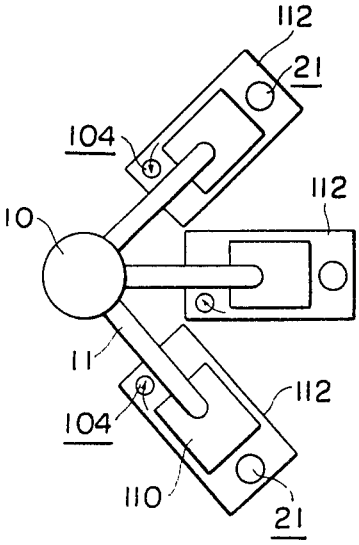
FIG. 8 is a partial plan view of FIG. 7.

FIGS. 7 and 8 illustrate another embodiment of the present invention, in which each stage of every condenser block 110 is received in a separate compartment while in the first embodiment, the compartments 16*a*, 16*b*, 16*c* accommodate all the parts 1*a*, 1*b* or 1*c* of condenser blocks 1 in corresponding stages. That is, for each stage the parts 110*a*, 110*b*, 110*c* of the condenser blocks are separately received in individual compartments 112, 114 or 116. With such a construction, each compartment 112, 114, 116 is fairly small in volume as compared to each of the compartments 16*a*, 16*b*, 16*c*, 106*a*, 106*b*, 106*c* in the first and second embodiments and also overall volume of the compartments 112, 114, 116 is smaller than that of the compartments 16*a*, 16*b*, 16*c* or 106*a*, 106*b*, 106*c*. Thus, Liquid oxygen is rapidly stored in the compartments 112, 114, 116 and hence the starting time of the condenser is shortened. Further, spaces are formed between adjacent compartments of the same stage and hence oxygen gas ascending passages are increased. For each condenser block 110 there are provided liquid oxygen guide passage 21, upper stage overflow passage 104, middle stage overflow passage 18*b*, and liquid oxygen blow conduits 22*a*, 22*b*, 22*c* (not shown).

What is claimed is:

1. A condenser-evaporator for use in a large air separation plant in which the condenser-evaporator is provided between an upper column and a lower column, the condenser-evaporator condensing nitrogen gas, ascending from the lower column through first conduit means, by heat exchange with liquid oxygen flowing down from an upper column through second conduit means, the improvement which comprises:

(a) a plurality of vertical evaporator blocks each having upper and lower ends and lateral edges and including first corrugated fins for forming nitrogen passages as nitrogen chambers, second corrugated fins for forming oxygen passages as oxygen chambers, the first fins and the second fins being each alternatively laminated through a separating plate to vertically form the nitrogen passages each opening at the upper and the lower ends of the condenser block and to form the oxygen passages each opening at the lateral edges of the condenser block, the oxygen chambers of each condenser block being divided into vertically disposed multistage groups;

(b) a first header provided to the upper end of each condenser block, the first header being connected to the first conduit means for introducing nitrogen gas from the lower column into the nitrogen chambers of the condenser blocks;

(c) a second header provided to the lower end of each condenser block;

(d) a third conduit means, connected to each second header, for extracting nitrogen condensed in the nitrogen chambers of the condenser blocks;

(e) means for forming vertically disposed multistage compartments for holding liquid oxygen including a lowermost stage compartment, the compartments forming means including a head portion of the lower column for forming the lowermost compartment;

(f) overflowing means, provided to each compartment disposed above the lowermost compartment, for overflowing liquid oxygen supplied from the upper column substantially at a level to immerse each group of the oxygen chambers in the liquid oxygen;

(g) fourth conduit means, communicated to the overflowing means, for introducing the liquid oxygen overflowing from one compartment into another lower compartment disposed just below the one compartment; and (h) oxygen gas ascending means, communicated to each compartment, for ascending and introducing into the upper column oxygen gas produced in each compartment by heat exchange with nitrogen gas.

2. A condenser-evaporator as recited in claim 1, wherein the oxygen passages of the condenser blocks are substantially horizontally formed.

3. A condenser-evaporator as recited in claim 1, wherein the oxygen passages of the condenser blocks are formed with an angle at least 5 degrees with respect to a horizontal plane.

4. A condenser-evaporator as recited in claim 1, wherein the compartments forming means comprises partition members for dividing the oxygen chambers of each condenser block into the vertically disposed multistage groups.

5. A condenser-evaporator as recited in claim 1, wherein the compartments disposed above the lower most compartment divide at bottoms thereof the oxygen chambers into the vertically disposed multistage groups.

6. A condenser-evaporator as recited in claim 1, wherein each oxygen passage comprises a vertical passage, a horizontal inlet passage communicated at one end thereof to a lower end of the vertical passage for introducing liquid oxygen thereinto and a horizontal outlet passage communicated at one end thereof to an upper end of the vertical passage, the vertical passage being longer than each of the horizontal inlet and outlet passages.

7. A condenser-evaporator as recited in claim 1, 2, 3, 4, 5 or 6, wherein each second corrugated fin for forming the oxygen passages is perforated.

8. A condenser-evaporator as recited in claim 1, 2, 3, 4, 5 or 6, wherein each first corrugated fin for forming the nitrogen passages is perforated.

9. A condenser-evaporator as recited in claim 1, wherein the compartment of each stage surrounds all the condenser blocks in the stage.

10. A condenser-evaporator as recited in claim 1, wherein the compartment forming means are provided to each of the condenser blocks to thereby separately surround each condenser block, the compartment of each stage surrounding part, disposed in the stage, of the condenser block.

11. A condenser-evaporator as recited in claim 1, wherein the first conduit means for introducing nitrogen gas from the lower column into the nitrogen chambers of the condenser blocks comprises: a vertical conduit connected to the center of the head of the lower column and vertically extending; and a plurality of branch conduits branching from an upper portion of the vertical conduit and communicating to the header disposed to the upper end of each condenser block, and wherein the condenser blocks are disposed around the vertical conduit.

* * * * *